US005134960A

United States Patent [19]

Shirai

[11] Patent Number: 5,134,960

[45] Date of Patent: Aug. 4, 1992

[54] TONER SEAL FOR DEVELOPING UNIT IN PROCESS CARTRIDGE

[75] Inventor: Hiroyuki Shirai, Tokyo, Japan

[73] Assignee: Canon Kabushiki Kaisha, Tokyo, Japan

[21] Appl. No.: 529,544

[22] Filed: May 29, 1990

[30] Foreign Application Priority Data

May 31, 1989 [JP] Japan ..... 1-138777

[51] Int. Cl.[5] ..... G03G 15/08

[52] U.S. Cl. ..... 118/653; 118/651; 355/215; 355/245; 355/260

[58] Field of Search ..... 355/200, 210, 245, 259, 355/260, 215; 118/651, 653, 661, 657, 647; 346/160; 358/300

[56] References Cited

U.S. PATENT DOCUMENTS

| | | | |
|---|---|---|---|
| 3,809,012 | 5/1974 | Delvecchio | 118/653 X |
| 4,341,179 | 7/1982 | Hosono et al. | 118/658 |
| 4,373,468 | 2/1983 | Suda et al. | 355/260 X |
| 4,387,664 | 6/1983 | Hosono et al. | 118/658 |
| 4,575,221 | 3/1986 | Onoda et al. | 355/200 |
| 4,596,455 | 6/1986 | Kohyama et al. | 355/260 |
| 4,616,918 | 10/1986 | Kohyama et al. | 355/259 |
| 4,676,192 | 6/1987 | Yuge et al. | 118/657 X |
| 4,785,319 | 11/1988 | Fujino et al. | 346/160 |

FOREIGN PATENT DOCUMENTS

| | | | |
|---|---|---|---|
| 255713 | 2/1988 | European Pat. Off. . | |
| 330225 | 8/1989 | European Pat. Off. . | |
| 129664 | 6/1986 | Japan . | |
| 143073 | 6/1987 | Japan . | |
| 192768 | 8/1987 | Japan . | |
| 192770 | 8/1987 | Japan . | |
| 0192770 | 8/1987 | Japan | 355/215 |
| 0208073 | 9/1987 | Japan | 355/215 |
| 246082 | 10/1987 | Japan . | |
| 0202773 | 8/1988 | Japan . | |
| 50179 | 6/1989 | Japan . | |

*Primary Examiner*—R. L. Moses
*Assistant Examiner*—J. E. Barlow, Jr.
*Attorney, Agent, or Firm*—Fitzpatrick, Cella, Harper & Scinto

[57] ABSTRACT

A developing apparatus includes an elastic blade contacted to a developing roller to regulate a thickness of a layer of a developer to be formed on the developing roller. To the longitudinal end portions of the developing roller, seals are press-contacted to prevent leakage of the developer. Each of the seals has a projection toward the longitudinally central portion of the developing roller. The projection is overlaid on the blade at a position where the blade and the developing roller are contacted.

27 Claims, 5 Drawing Sheets

TONER SEAL FOR DEVELOPING UNIT IN PROCESS CARTRIDGE

FIELD OF THE INVENTION AND RELATED ART

The present invention relates to a developing apparatus for developing an electrostatic latent image in an electrostatic recording apparatus such as an electrophotographic copying machine or an electrophotographic laser beam printer and to a process cartridge or unit including an image bearing member and at least the developing apparatus.

In the developing apparatus, a developer carrying member usually in the form of a roller rotates to carry a developer to a developing zone where the image bearing member is disposed. In the developing zone, the developer is supplied from the developer carrying member to the image bearing member to develop the electrostatic latent image.

A part of a travel of the peripheral surface of the developer carrying member is exposed and faced to a developer supply chamber, in which the developer is supplied onto the peripheral surface of the developer carrying member. The developer applied on the developer carrying member is subjected to a layer thickness regulating operation by a regulating member, and then, is carried to the developing zone.

As for the regulating member, U.S. Pat. No. 4,387,664, for example, proposes an elastic plate contacted to the developer carrying member, wherein the elastic member is contacted to the developer carrying member, and the developer is passed through a nip formed therebetween, by which the thickness of the layer of the developer is regulated. This method is advantageous since a uniformly thin layer of the developer can be formed and since the developer can be sufficiently triboelectrically charged.

In order to prevent the developer from leaking out through longitudinal ends of the developer carrying member, U.S. Pat. No. 4,387,664 proposes a sealing member mounted on a side wall of the developer supply chamber, and the sealing member is contacted to each of the ends of the developer carrying member over generally one half of the circumference of the developer carrying member. The similar method is disclosed also in U.S. Pat. Nos. 4,341,179 and 4,373,468, for example.

When there is a gap between the regulating member and the developer carrying member, and therefore, the regulating member may be made of rigid material, the sealing member may be abutted with strong pressure to each of the end surfaces, and therefore, no gap is required to be provided between the regulating member and the sealing member.

However, where the regulating member is made of elastic material because of the contact thereof with the developer carrying member, the regulating member can be deformed elastically if the sealing member is abutted with strong force to the end surface of the regulating member. If this occurs, the thickness of the developer layer formed may be non-uniform.

Even if the sealing member for the leakage prevention is abutted to each of the end surfaces of the regulating member with weak force in an attempt to solve the problem, the pressure of abutment is not uniform with the result that the leakage prevention of the developer at the longitudinal ends is not reliable. In addition, the dimensional accuracies of the parts of the developing apparatus such as the regulating member are required to be even higher, which is not desirable from the standpoint of the productivity, cost or the like.

On the other hand, U.S. Pat. No. 4,785,319, for example, discloses a process unit detachably mountable to an image forming apparatus and including an image bearing member and a developing device, or further a charger or a cleaning device supported by supporting means as a unit. Such a process unit is desired because a high quality image can be maintained for a long period of time by exchanging the process unit, while the necessity of expert maintenance is reduced. However, since the process unit is mounted to or dismounted from the main assembly of the image forming apparatus by manual operation by an operator, it is desired that the size of the unit is small. Therefore, the developing device therein is required also to be small. Then, the size of the developer carrying member is desired to be small. In order to regulate the layer of the developer on the developer carrying member having a small size into a thin layer while maintaining the sufficient triboelectric charge of the developer, it is effective to use an elastic plate contacted to the developer carrying member as the layer thickness regulating member. However, if the developer leaks out through the end portions of the developer carrying member, the leaked developer contaminates the inside of the process unit and also the main assembly of the image forming apparatus, thus reducing the advantage of using the process unit.

SUMMARY OF THE INVENTION

Accordingly, it is a principal object of the present invention to provide a developing apparatus wherein the leakage of the developer at the longitudinal ends of the regulating member can be prevented by leakage preventing sealing members, and in addition, the productivity thereof is good with low cost.

It is another object of the present invention to provide a process unit having an image bearing member and a developing device as a unit, the developing device including a developer regulating member contacted to the developer carrying member, wherein the leakage of the developer through the end portions of the developer carrying member is prevented to reduce the contamination of the inside of the process unit or the inside of the image forming apparatus.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
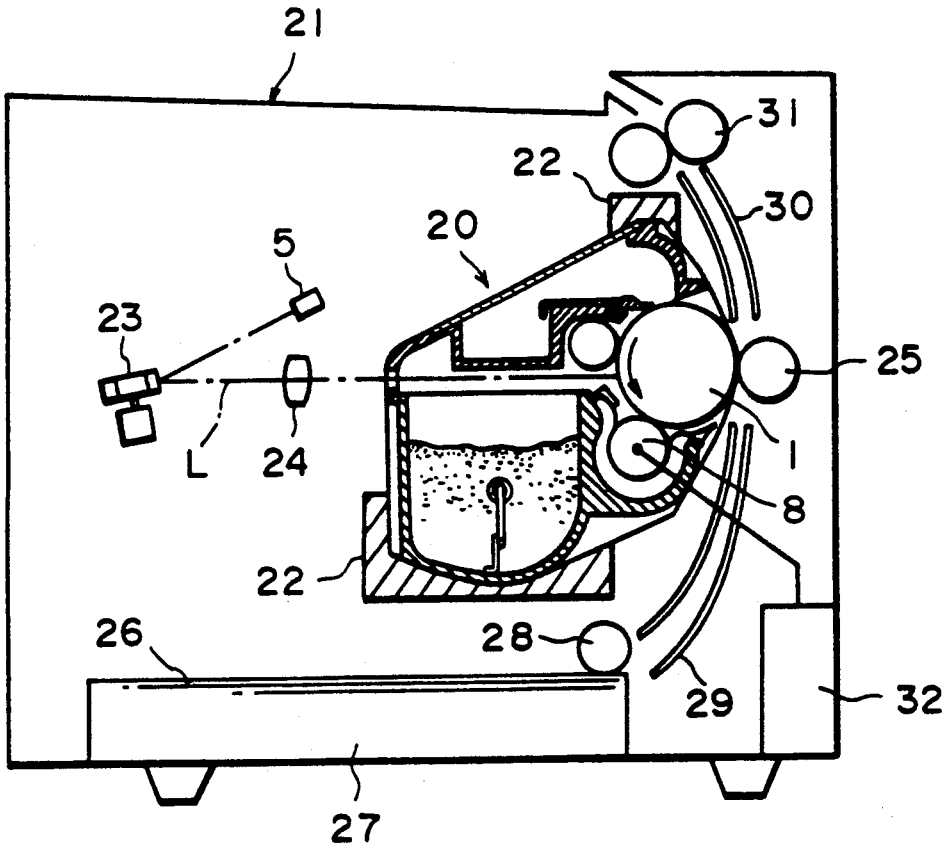
FIG. 1 is a sectional view of an image forming apparatus to which the present invention is applicable.

Referring to FIG. 1, there is shown a laser beam printer as an exemplary image forming apparatus to which the present invention is applicable. The laser beam printer contains a process unit 20 which will be described in detail hereinafter. The process unit 20 is detachably mountable into the main assembly of the printer along a guide rail 22 provided inside the main assembly of the printer 21, by manual operation of the operator. The operator takes a unit 20 out of the printer main assembly after it reaches the end of the service life, and mounts a fresh unit 20 to the main assembly of the printer.

The unit 20 contains an electrophotographic photosensitive member 1 in the form of a drum. The photosensitive member 1 is scanned by a laser beam L, by which an electrostatic latent image is formed on the photosensitive member 1 through a known process. A semiconductor laser 5 produces a laser beam L modulated in accordance with record image signals supplied from an original reader, computer or the like.

The laser beam L is scanningly deflected by scanning means such as a rotational polygonal mirror 23 or the like. The laser beam is incident on the photosensitive member 1 through a lens 24.

The electrostatic latent image formed on the photosensitive member 1 is developed by a developing device which will be described hereinafter. The visualized image provided by the development by the developing means is transferred from the photosensitive member 1 to a transfer material 26 such as paper.

The transfer material 26 is conveyed from a cassette 27 by a conveying roller 28 through a guide 29 toward an image transfer roller 25. After receiving the transferred image, the transfer material 26 is conveyed to an image fixing device 31 through a guide 30. The image fixing device 31 fixes the image on the transfer material, and the transfer material is discharged outside the apparatus.

A voltage source 32 is connected with the developing sleeve 8 of the developing device when the unit 20 is mounted in the main assembly of the printer 21 to supply a vibratory bias voltage to the developing sleeve during the developing operation.

Figure 2:
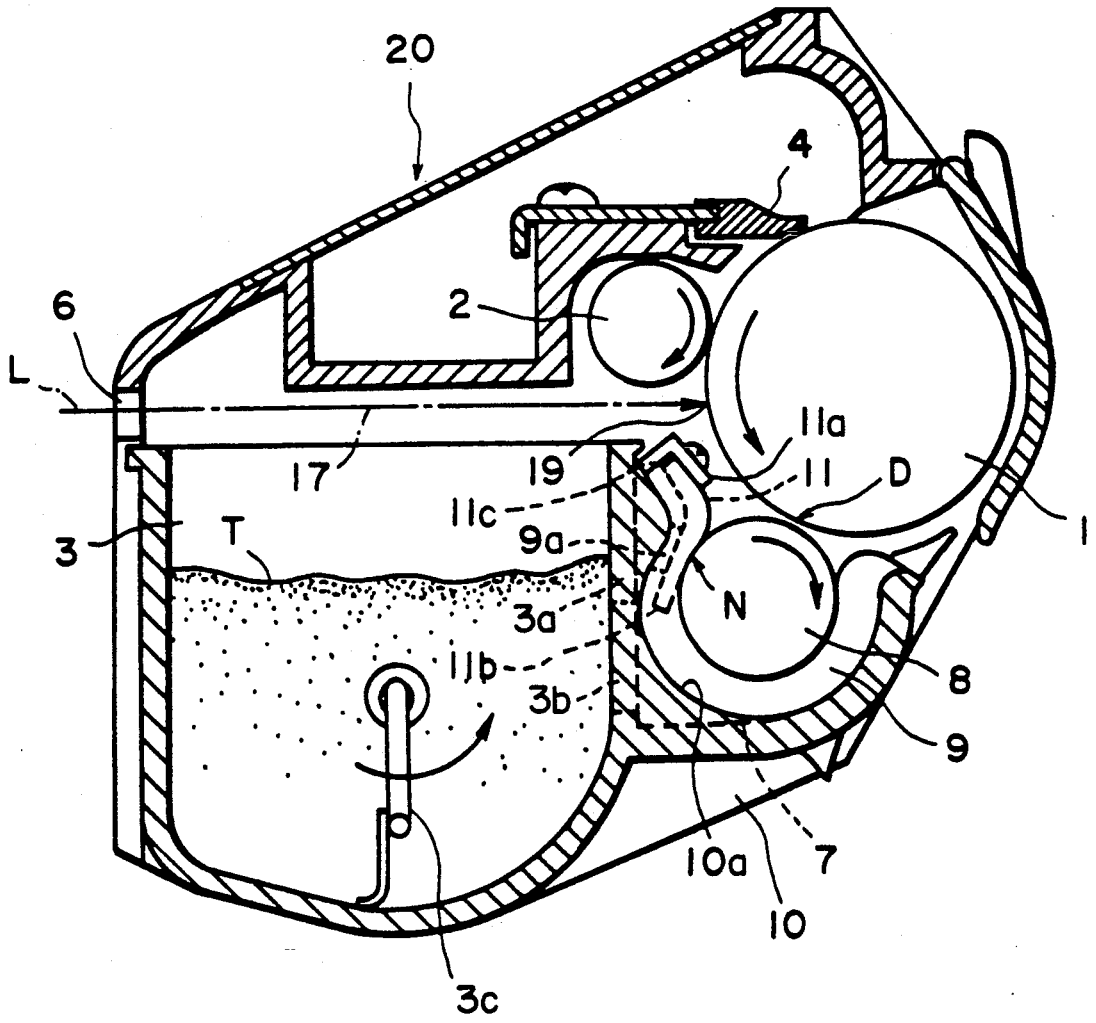
FIG. 2 is a sectional view of a developing apparatus according to an embodiment of the present invention.

FIG. 2 shows a sectional view of the process unit 20. Various members in the process unit are supported as a unit by a frame 10.

Through a slit-like exposure window 6 formed in a rear side of the unit 20, the laser beam L is projected into the unit 10 substantially horizontally, and it is incident through an optical path 17 on the photosensitive member (image bearing member) 1 at an image exposure position 19, the photosensitive member 1 having been charged by a charger 2. By the projection of the laser beam L, an electrostatic latent image is formed on the photosensitive member. The photosensitive member 1 is rotationally driven in the direction indicated by an arrow. After the image transfer, the residual developer remaining on the photosensitive member 1 is removed by a blade 4 (cleaning means). At a position between the blade 4 and the exposure position 19, the charger 2 is disposed which includes a contact type charging member or a friction charging roller. The charger 2 may be in the form of a corona charger.

Below the optical path 17 leading the image information beam L, there is a developer container 3 for containing a one component developer T. Adjacent to the container 3, there is a developer supply chamber 7. The unit 20 includes a rotatable developing sleeve 8 in the form of a cylinder. The circumferential travel thereof is partly exposed to the inside of the developer supply chamber 7, and partly faced to the photosensitive member 1. Into the developer supply chamber 7, the developer is supplied by a developer conveying member 3c rotating in the direction indicated by an arrow through an opening 3b formed in a partition wall 3a of the container 3. The developing sleeve 8 is rotatable in the direction indicated by an arrow. In the developer supply chamber 7, there are provided a developer amount regulating member (regulating blade) 11 and developer leakage preventing members 9.

When a magnetic developer is used as the one component developer T, or a two component developer containing magnetic carrier particles and toner particles, the sleeve 8 is non-magnetic, and a magnet is disposed within the sleeve 8. When a non-magnetic developer is used as the one component developer, the magnet is not necessary, and the developer carrying member 8 may be in the form of a solid roller.

The developer T in the developer supply chamber 7 is deposited on the sleeve 8 by electrostatic attraction force or magnetic attraction force or the like. The thickness of the layer of the developer applied on the sleeve 8 is regulated by a regulating blade 11 of elastic material elastically press-contacted to the sleeve 8 at a side surface thereof at the position N, into a thickness smaller than the minimum clearance between the photosensitive member 1 and the sleeve 8 in the developing zone. Thus, in this embodiment, the so-called non-contact development operation is carried out. In order to increase the development efficiency in the non-contact development, a vibratory bias voltage (a DC biased AC voltage, for example) is applied to the developing sleeve 8 conveying the developer to the developing zone D, by which a vibratory electric field having periodically alternating directions is formed in the developing zone D. A DC bias voltage may be applied on the sleeve 8.

The minimum clearance between the photosensitive drum 1 and the sleeve 8 is preferably 0.05–0.7 mm in the developing zone D. The blade 11 for forming the thin layer of the developer on the sleeve is made of rubber plate (urethane rubber, silicone rubber or the like) having a thickness of 0.5–1.5 mm, an elastic metal plate (phosphor bronze, stainless steel or the like) having a thickness of 0.02–0.2 mm, or a synthetic resin plate (polyethylene terephthalate or the like) having a thickness of 0.05–0.5 mm, or the like. Such plates have sufficient bending elasticity. Among them, a rubber plate is preferable because it can be press-contacted to the surface of the sleeve with uniform pressure.

Figure 3:
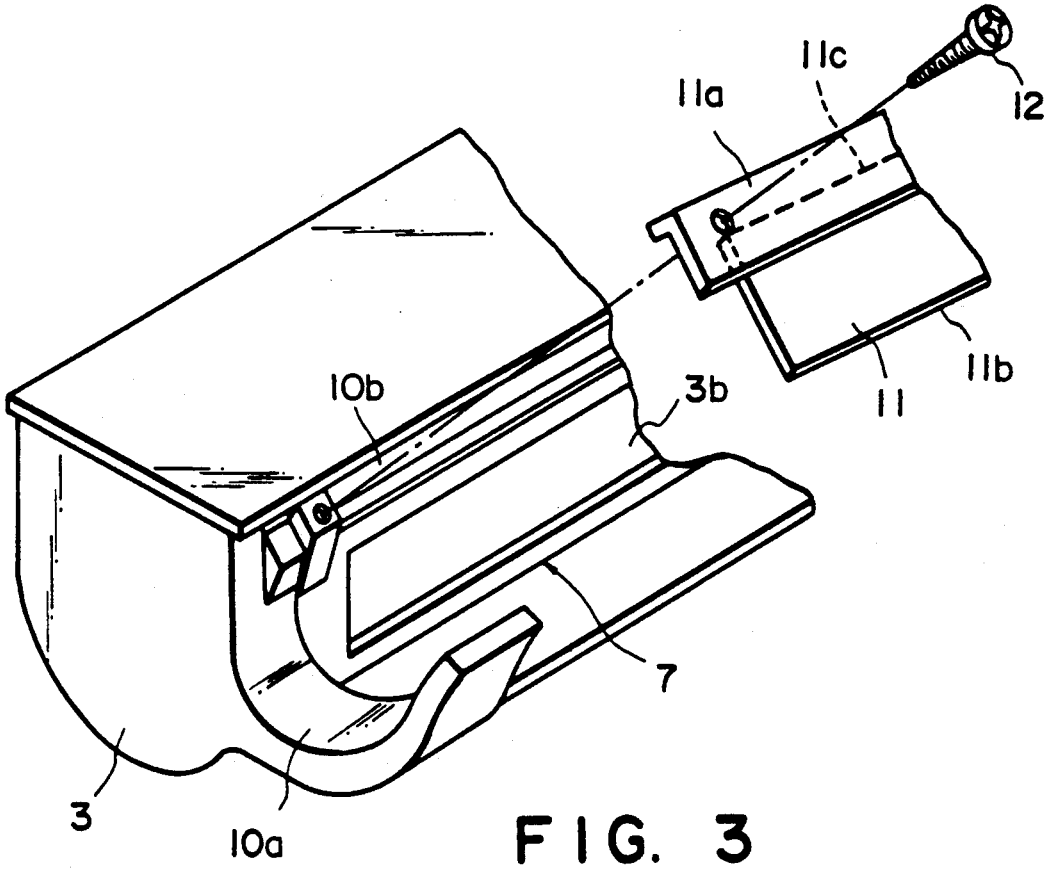
FIG. 3 is a perspective view of a part of the developing device, partly broken away.
Figure 6:
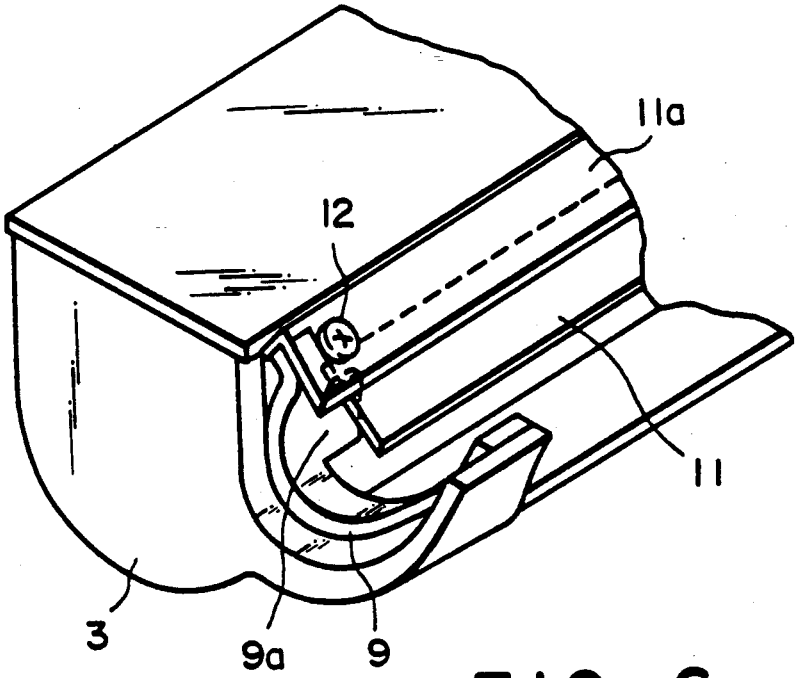
FIG. 6 is a perspective view of the developing apparatus without the sleeve.

The blade 11 is fixed on a supporting plate 11a by bonding agent or the like. As shown in FIGS. 3 and 6, the supporting plate 11a is fixed by screws 12 to end portions of a mounting portion 10b extending between the arcuate internal end walls 10a of the developer supply chamber 7 at its both longitudinal ends. The blade 11 is curved in the developer supply chamber 7, as shown in FIG. 2, and is elastically contacted to the sleeve 8. The developer is regulated in its layer thickness during passage through the nip formed between the blade 11 and the sleeve 8, and in addition, during this, the developer is triboelectrically charged by the friction with the sleeve and with the blade to such an extent as to be sufficient to develop the latent image. In the shown example, the blade 11 is counter-directionally contacted to the sleeve 8 relative to the rotational direction of the sleeve 8. More particularly, the free end 11*b* of the blade 11 is upstream of the fixed end 11*c* at which the blade is fixed to the supporting plate 11*a*. With this arrangement, the thickness of the developer layer becomes small. However, the blade 11 may be contacted to the sleeve 8 codirectionally with respect to the rotational direction of the sleeve 8, that is, in the direction opposite to the shown example. In this case, the free end 11*b* of the blade 11 is disposed downstream of the fixed end 11*c*, relative to the rotational direction of the sleeve 11.

In the shown example, the side of the blade 11 is contacted to the sleeve 8 at a position slightly downstream of the free end 11*b* of the blade 11 toward downstream with respect to the rotational direction of the sleeve. Therefore, a slight gap or slit is formed between the free end 11*b* of the blade 11 and the sleeve 8 surface. Since the developer is introduced into the nip formed between the blade 11 and the sleeve 8 through the gap, it is important that the gap is formed when the blade 11 is counter-directionally contacted to the sleeve in the sleeve rotation direction.

When, on the other hand, the blade 11 is contacted to the sleeve codirectionally, the free end 11*b* may be or may not be contacted to the sleeve 8 if the side of the blade 11 is contacted to the sleeve 8.

In order to prevent the leakage of the developer through the opposite longitudinal ends of the sleeve 8, developer leakage preventing seal members 9 are provided in sliding contact with the sleeve 8 adjacent its longitudinal ends and outside the opposite longitudinal ends of the blade 11. As shown in FIG. 2, the sealing members 9 are press-contacted to the outer peripheral surface of the sleeve 8, as if it is wrapped therearound, in the range from an inlet where the developer on the sleeve 8 having passed through the developing zone D returns to the supply chamber 7 by the rotation of the sleeve 8 to an outlet where the developer is discharged from the supply chamber 7 toward the developing zone D. As shown in FIGS. 2, 3, 5 and 6, the sealing members 9 is bonded on and along each of an arcuate internal end walls 10*a* of the developer supply chamber 7, and the top end portion thereof is confined by the supporting plate 11*a* of the regulating blade 11 fixed to the end portions of the mounting portion 10*b* of the developer supply chamber 7, by which each of the sealing member is fixed on the arcuate internal wall portion 10*a*. Thus, the sealing member 9 is sandwiched between the side wall of the developer supply chamber 7 and the sleeve 8, so that it is elastically compressed to a certain extent.

The sealing member 9 is made of felt or sheep wool, tetrafluoroethylene resin fibers or the like, or porous (foam material or continuous pore material) such as urethane foam rubber, Goatex (trade name, porous tetrafluoroethylene resin) or the like, and therefore, each of the sealing members 9 is flexible.

Figure 4:
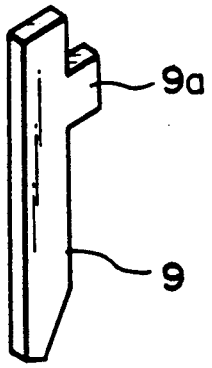
FIG. 4 is a perspective view of a sealing member.

In this embodiment, in order to assure that the sealing member 9 prevents leakage of the developer from opposite longitudinal end portions of the regulating blade 11 adjacent the opening faced to the photosensitive member 1, the sealing member 9 is provided with a projection 9*a* projected toward the regulating blade 11, as shown in FIG. 4. The projection 9*a* projects toward the regulating blade 11, that is, toward the longitudinal central portion of the sleeve 8 at a position where the regulating blade 11 is contacted to the peripheral surface of the developing sleeve 8.

Figure 5:
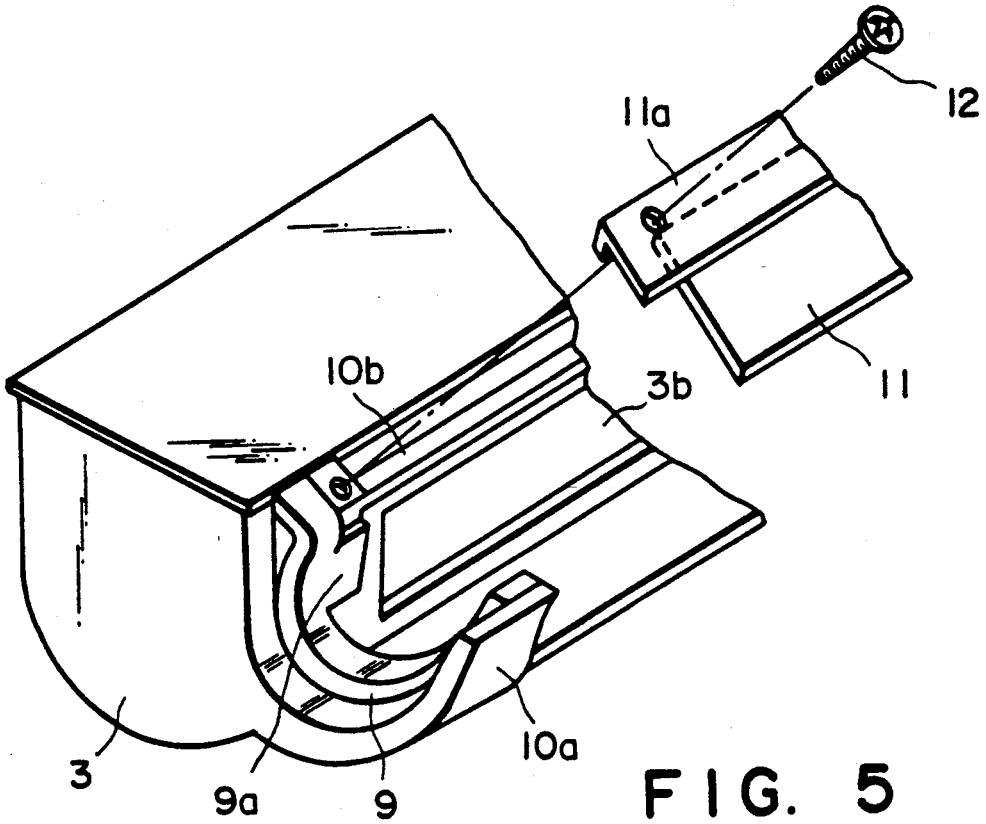
FIG. 5 is a perspective view of a part of the developing apparatus illustrating the mounting between the sealing member and the blade.
Figure 7:
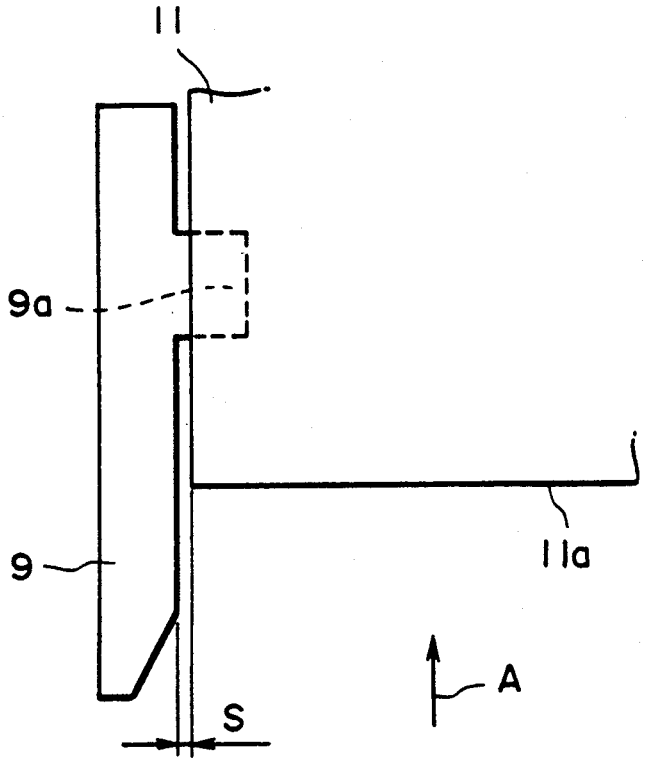
FIGS. 7, 8 and 9 are developed views of the blade and the sealing member, as seen from the side of the sleeve.

Therefore, as shown in FIGS. 2, 5 and 6, when the sealing member 9 is mounted on the arcuate internal wall portion 10*a* of the developer supply chamber 7, the projection 9*a* is urged to the regulating blade 11 by the internal wall portions continuing from the arcuate internal wall portion 10*a* of the developer supply chamber 7 at a position where the regulating blade 11 is in contact with the outer peripheral surface of the developing sleeve 8, by which the projection 9*a* is elastically compressed and deformed. By this, the longitudinal end portions of the regulating blade 11 are overlaid with the projection 9*a* in the manner that it is sandwiched between the projections 9*a* of the sealing member 9 and the peripheral surface of the developing sleeve 8. As shown in FIG. 7, a gap S between the sealing member 9 and the regulating blade 11 is substantially sealed by the projection 9*a* of the sealing member 9 at the position where the longitudinal end portions of the regulating blade 11 are contacted to the developing sleeve 8 surface. This assures that the leakage of the developer through the gap S toward the outside is prevented.

Figure 8:
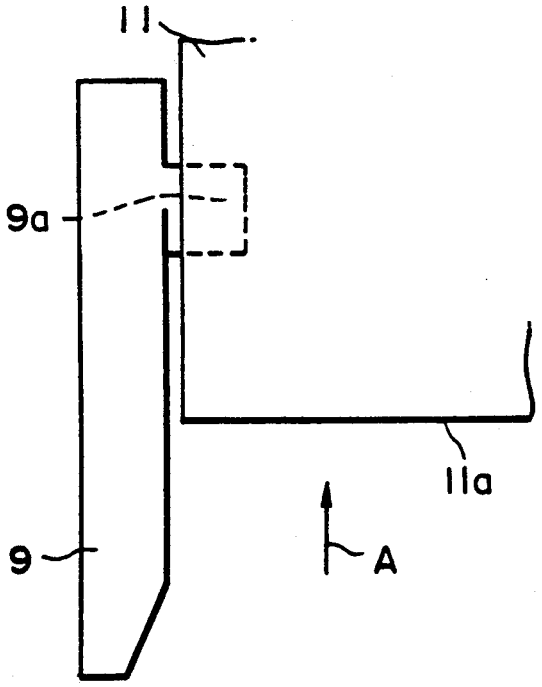

As shown in FIG. 8, a cut or a slit 13 extending along a length of the sealing member 9 may be formed at a base portion of the projection 9*a* adjacent the free end of the blade 11. By doing so, the pressure to the longitudinal end portions of the regulating blade 11 resulting from the provision of the projection 9*a* can be reduced, so that the uniformity of the thickness of the developer layer is enhanced, and in addition, the driving torque required for driving the developing sleeve 8 can be reduced.

Figure 9:
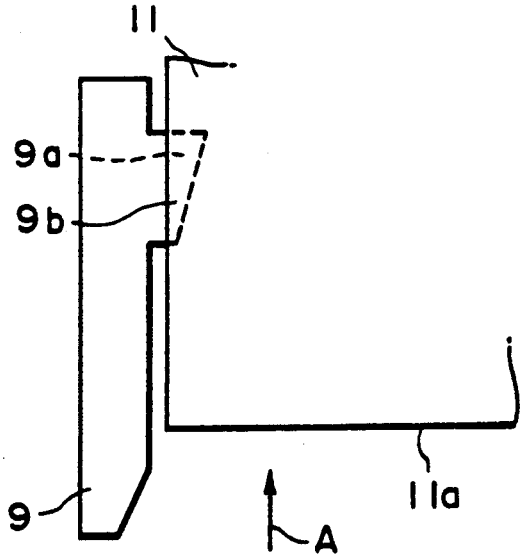

As shown in FIG. 9, a tapered surface 9*b* may be formed at the free end of the projection 9*a*, the tapered surface 9*b* being such that its downstream portion is closer to the longitudinally central portion of the sleeve 8 than its upstream portion with respect to the rotational direction of the sleeve 8. By doing so, the flow of the developer may be urged toward the longitudinally central portion of the sleeve 8 along the tapered surface 9*b*, by which the leakage prevention by the sealing member 9 adjacent the opposite longitudinal ends of the developing sleeve 8, can be further assured. In FIGS. 7, 8 and 9, an arrow A indicates a movement direction of the developer which is the same as the rotational direction of the sleeve in this embodiment.

The projection 9*a* of the sealing member 9 is preferably not contacted to the free end 11*a* of the blade 11 but is contacted to the end portions of the blade 11 slightly away from the free end 11*e* toward the fixed end of the blade 11, because, if the free end 11*e* of the blade 11*a* is urged by the sealing member to the sleeve 8, the amount of developer leaking under the free end 11*a* becomes not uniform along the length of the blade with the possible result of non-uniformity in the developer layer thickness.

During the regulation of the layer thickness of the developer, a thin layer of the developer is present in the nip between the blade 11 and the sleeve 8, and therefore, the blade 11 is not contacted to the sleeve 8 in a strict sense. However, when the developer is not present between the blade 11 and the sleeve 8, the blade 11 is elastically contacted to the sleeve 8, and in addition, the blade 11 is elastically urged to be contacted to the sleeve 8, and therefore, it is said in this specification for convenience that the blade 11 is "contacted" to the sleeve 8, and that the developer is passed through the nip or "contact portion" therebetween.

In the foregoing embodiment, the developing device is contained in a process unit containing a photosensitive member. However, the present invention is applicable to a developing device fixed in the main assembly of an image forming apparatus, or to a developing device which is detachably mountable to an image forming apparatus independently from the photosensitive member.

As for the means for exposing the photosensitive member to image information light, an array of light emitting diodes may be used in place of the laser beam. As a further alternative, the photosensitive member may be exposed to the light reflected or passed through an original to be reproduced. The image bearing member may be a member having an insulative surface to which a flow of ions modulated in accordance with record signal is applied to form a latent image.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus for developing an electrostatic latent image formed on an image bearing member, comprising:

a developer supply chamber;

a rotatable developer carrying member, disposed so as to at least partly face said developer supply chamber, for rotatably carrying the developer supplied thereto in said developer supply chamber to a developing zone where an image bearing member moves;

an elastic regulating plate in contact with said rotatable developer carrying member to regulate a thickness of a layer of the developer to be rotatably carried to said developing zone by said rotatable developer carrying member;

a flexible sealing member in contact with an end portion of said rotatable developer carrying member to prevent leakage of the developer at an end portion of the rotatable developer carrying member;

wherein said sealing member has a projection directed toward a central portion of said rotatable developer carrying member at a position corresponding to a position where said regulating plate is in contact with said rotatable developer carrying member, said projection projecting toward the central portion at a position between front and rear portions of the sealing member with respect to a rotational movement direction of said rotatable developer carrying member, and said projection being overlaid on an end portion of said regulating plate to cooperate with said rotatable developer carrying member to sandwich the end portion of said regulating plate.

2. An apparatus according to claim 1, wherein said projection is overlaid with said regulating plate at a position away from a free end of said regulating plate.

3. An apparatus according to claim 2, wherein a gap is provided between a free end of said regulating plate and said developer carrying member.

4. An apparatus according to claim 1, 2 or 3, wherein a length of said projection is longer at a downstream portion than at the upstream portion with respect to a movement direction of the developer.

5. An apparatus according to claim 1, 2 or 3, wherein said regulating plate is made of rubber, metal leaf spring plate or synthetic resin material, and wherein said sealing member is made of felt or porous material.

6. An apparatus according to claim 1, 2 or 3, wherein said regulating plate is contacted to said developer carrying member counterdirectionally with respect to a movement direction of said developer carrying member.

7. A process unit, comprising:

an image bearing member on which an electrostatic latent image is formed;

a developing means for developing the electrostatic latent image formed on said image bearing member; and supporting means for supporting as a unit said image bearing member and said developing means;

wherein said developing means includes:

a developer supply chamber;

a rotatable developer carrying member, disposed so as to at least partly face said developer supply chamber, for rotatably carrying the developer supplied thereto in said developer supply chamber to a developing zone where an image bearing member moves;

an elastic regulating plate in contact with said rotatable developer carrying member to regulate a thickness of a layer of the developer to be rotatably carried to said developing zone by said developer carrying member;

a flexible sealing member in contact with an end portion of said rotatable developer carrying member to prevent leakage of the developer at an end portion of the rotatable developer carrying member;

wherein said sealing member has a projection directed toward a central portion of said rotatable developer carrying member at a position corresponding to a position where said regulating plate is in contact with said rotatable developer carrying member, said projection projecting toward the central portion at a position between front and rear portions of the sealing member with respect to a rotational movement direction of said rotatable developer carrying member, and said projection being overlaid on an end portion of said regulating plate to cooperate with said rotatable developer carrying member to sandwich the end portion of said regulating plate.

8. A process unit according to claim 7, wherein said projection is overlaid with said regulating plate at a position away from a free end of said regulating plate.

9. A process unit according to claim 8, wherein a gap is provided between a free end of said regulating plate and said developer carrying member.

10. A process unit according to claim 7, 8 or 9, wherein a length of said projection is longer at a downstream portion than at the upstream portion with respect to a movement direction of the developer.

11. A process unit according to claim 7, 8 or 9, wherein said regulating plate is made of rubber, metal leak spring plate or synthetic resin material, and wherein said sealing member is made of felt or porous material.

12. A process unit according to claim 7, 8, or 9 wherein said regulating plate is in contact with said rotatable developer carrying member counterdirectionally with respect to the rotational movement direction of said developer carrying member.

13. A process unit according to claim 9, 8 or 9, comprising:

a charging member supported by said supporting means;

an opening formed at a position downstream of said charging member with respect to a movement direction of said image bearing to permit passage of image information light to be projected onto said image bearing member to form the electrostatic latent image; and a cleaning member supported by said supporting means for removing the developer remaining on said image bearing member before charging operation by said charging member.

14. A developing apparatus for developing an electrostatic latent image formed on an image bearing member, comprising:

a developer supply chamber;

a rotatable developer carrying member, disposed so as to at least partly face said developer supply chamber, for rotatably carrying the developer supplied thereto in said developer supply chamber to a developing zone where an image bearing member moves;

an elastic regulating plate in contact with said rotatable developer carrying member to regulate a thickness of a layer of the developer to be rotatably carried to said developing zone by said rotatable developer carrying member;

a flexible sealing member in contact with an end portion of said rotatable developer carrying member to prevent leakage of the developer at an end portion of the rotatable developer carrying member;

wherein said sealing member has a projection directed toward a central portion of said rotatable developer carrying member at a position corresponding to a position where said regulating plate is contacted to said rotatable developer carrying member, said projection projecting toward the central portion at a position between front and rear portions of the sealing member with respect to a rotational movement direction of said rotatable developer carrying member, and said projection being overlaid on an end portion of said regulating plate to cooperate with said rotatable developer carrying member to sandwich the end portion of said regulating plate; and wherein said projection has a base portion where a cut is formed along the direction of rotational movement of said rotatable developer carrying member.

15. An apparatus according to claim 14, wherein said projection is overlaid with said regulating plate at a position away from a free end of said regulating plate.

16. An apparatus according to claim 15, wherein a gap is provided between a free end of said regulating plate and said rotatable developer carrying member.

17. An apparatus according to claim 15 or 16, wherein a length of said projection is longer at a downstream portion than at the upstream portion with respect to a movement direction of the developer.

18. An apparatus according to claim 15 or 16, wherein said regulating plate is made of rubber, metal leaf spring plate or synthetic resin material, and wherein said sealing member is made of felt or porous material.

19. An apparatus according to claim 15 or 20, wherein said regulating plate is in contact with said rotatable developer carrying member counterdirectionally with respect to the rotational movement direction of said rotational developer carrying member.

20. A process unit, comprising:

an image bearing member on which an electrostatic latent image is formed;

a developing means for developing the electrostatic latent image formed on said image bearing member; and supporting means for supporting as a unit said image bearing member and said developing means;

wherein said developing means includes:

a developer supply chamber;

a rotatable developer carrying member, disposed so as to at least partly face said developer supply chamber, for rotatably carrying the developer supplied thereto in said developer supply chamber to a developing zone where an image bearing member moves;

an elastic regulating plate in contact with said rotatable developer carrying member to regulate a thickness of a layer of the developer to be carried to said developing zone by said rotatable developer carrying member;

a flexible sealing member in contact with an end portion of said rotatable developer carrying member to prevent leakage of the developer at an end portion of the rotatable developer carrying member;

wherein said sealing member has a projection directed toward a central portion of said rotatable developer carrying member at a position corresponding to a position where said regulating plate is contacted to said rotatable developer carrying member, said projection projecting toward the central portion at a position between front and rear portions of the sealing member with respect to a rotational movement direction of said rotatable developer carrying member, and said projection being overlaid on an end portion of said regulating plate to cooperate with said rotatable developer carrying member to sandwich the end portion of said regulating plate; and wherein said projection has a base portion where a cut is formed along the direction of rotational movement of said rotatable developer carrying member.

21. A process unit according to claim 20, wherein said projection is overlaid with said regulating plate at a position away from a free end of said regulating plate.

22. A process unit according to claim 21, wherein a gap is provided between a free end of said regulating plate and said rotatable developer carrying member.

23. A process unit according to claim 21 or 22, wherein a length of said projection is longer at a downstream portion than at the upstream portion with respect to a movement direction of the developer.

24. A process unit according to claim 21 or 22, wherein said regulating plate is made of rubber, metal leaf spring plate or synthetic resin material, and wherein said sealing member is made of felt or porous material.

25. A process unit according to claim 21 or 22, comprising:

a charging member supported by said supporting means;

an opening formed at a position downstream of said charging member with respect to a movement direction of said image bearing to permit passage of image information light to be projected onto said image bearing member to form the electrostatic latent image; and a cleaning member supported by said supporting means for removing the developer remaining on said image bearing member before charging operation by said charging member.

26. An apparatus according to claim 1 or 14, wherein said regulating plate provides a layer of the developer having a thickness smaller than a gap between said rotatable developer carrying member and said image bearing member, and a vibratory voltage is applied to said rotatable developer carrying member.

27. A process unit according to claim 7 or 20, wherein said regulating plate provides a layer of the developer having a thickness smaller than a gap between said rotatable developer carrying member and said image bearing member, and a vibratory voltage is applied to said rotatable developer carrying member.

* * * * *

UNITED STATES PATENT AND TRADEMARK OFFICE

CERTIFICATE OF CORRECTION

PATENT NO. : 5,134,960

DATED : August 4, 1992

INVENTOR(S) : Shirai

It is certified that error appears in the above-identified patent and that said Letters Patent is hereby corrected as shown below:

COLUMN 1:

Line 50, "and therefore," should be deleted--.

COLUMN 5:

Line 15, "11." should read --8.--;
Line 45, "is" should read --are--; and
Line 50, "member" should read --members--.

COLUMN 8:

Line 63, "leak" should read --leaf--.

COLUMN 9:

Line 3, "claim 9, 8 or 9," should read --claim 7, 8 or 9,--.

COLUMN 10:

Line 1, "claim 15 or 20," should read --claim 15 or 16,--.

Signed and Sealed this

Fifth Day of October, 1993

*Attest:*

Bruce Lehman

BRUCE LEHMAN

*Attesting Officer*

*Commissioner of Patents and Trademarks*